US011678127B2

(12) United States Patent
Beck et al.

(10) Patent No.: US 11,678,127 B2
(45) Date of Patent: Jun. 13, 2023

(54) METHOD FOR OPERATING A HEARING SYSTEM, HEARING SYSTEM AND HEARING DEVICE

(71) Applicant: Sivantos Pte. Ltd., Singapore (SG)

(72) Inventors: Frank Beck, Spardorf (DE); Stefan Aschoff, Eckental (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 135 days.

(21) Appl. No.: 17/380,254

(22) Filed: Jul. 20, 2021

(65) Prior Publication Data

US 2022/0021986 A1 Jan. 20, 2022

(30) Foreign Application Priority Data

Jul. 20, 2020 (DE) ..... 102020209050.5

(51) Int. Cl.
*H04R 25/00* (2006.01)

(52) U.S. Cl.
CPC ..... *H04R 25/505* (2013.01); *H04R 2225/43* (2013.01); *H04R 2225/49* (2013.01)

(58) Field of Classification Search
CPC ..... H04R 25/505; H04R 2225/43; H04R 2225/49; H04R 25/70; H04R 2225/41; H04R 25/00; H04R 25/554
See application file for complete search history.

(56) References Cited

U.S. PATENT DOCUMENTS

| | | | | |
|---|---|---|---|---|
| 10,750,293 | B2 * | 8/2020 | Simonides | H04M 1/72412 |
| 2010/0220867 | A1 | 9/2010 | Frerking et al. | |
| 2011/0058698 | A1 | 3/2011 | Buhmann et al. | |
| 2015/0172831 | A1 | 6/2015 | Dittberner et al. | |
| 2015/0230036 | A1 * | 8/2015 | Pedersen | H04R 25/505 381/330 |
| 2019/0149927 | A1 * | 5/2019 | Zhang | H04R 25/505 704/271 |
| 2019/0174237 | A1 * | 6/2019 | Lunner | H04R 1/1041 |

FOREIGN PATENT DOCUMENTS

| | | | |
|---|---|---|---|
| CN | 104717593 | A | 6/2015 |
| DE | 10114015 | A1 | 10/2002 |
| EP | 3468227 | A1 | 4/2019 |

* cited by examiner

*Primary Examiner* — Tuan D Nguyen
(74) *Attorney, Agent, or Firm* — Laurence A. Greenberg; Werner H. Stemer; Ralph E. Locher

(57) ABSTRACT

A method operates a hearing system having a hearing device and modifies an input signal for the purpose of sound output to a user and, applies multiple algorithms with a respective potency, as a result of which a respective algorithm is applied with a present potency in a present situation. The hearing system recurrently receives a report from the user indicating that the user is dissatisfied with the sound output in the present situation. The hearing system has a database, containing multiple weights for each algorithm, to rate a change of the potency. If a report is received, each of the algorithms is rated using the weights to ascertain an individual-case relevance for each of the algorithms, to assess the effect of a change of the potency. Multiple individual-case relevances are combined to form a relevance value for each algorithm, the relevance values are compared with one another.

18 Claims, 4 Drawing Sheets

METHOD FOR OPERATING A HEARING SYSTEM, HEARING SYSTEM AND HEARING DEVICE

CROSS-REFERENCE TO RELATED APPLICATION

This application claims the priority, under 35 U.S.C. § 119, of German patent application DE 10 2020 209 050.5, filed Jul. 20, 2020; the prior application is herewith incorporated by reference in its entirety.

BACKGROUND OF THE INVENTION

Field of the Invention

The invention relates to a method for operating a hearing system, a hearing system and a hearing device.

A hearing system contains a hearing device, which is worn by a user on or in the ear. During operation, the hearing device picks up sounds from the surroundings by means of one or more microphones and generates an electrical input signal, which is converted back into sounds via a receiver of the hearing device and output to the user. The electrical input signal is processed by signal processing to form an electrical output signal for the receiver in order to adapt the hearing experience and the perception of the sounds for the personal requirements of the user. A hearing device is typically used to cater for a user with impaired hearing, i.e. to compensate for a hearing deficiency of the user. The signal processing then processes the electrical input signals in such a way that the hearing deficiency is compensated for. This is accomplished by using a previously ascertained audiogram for the user, for example.

It is conceivable for the signal processing to apply various algorithms for processing the input signal, depending on the situation. A respective algorithm is then used to specifically modify part of the input signal, e.g. in order to emphasize or reject the part. The relevant part is a signal feature in the input signal, which is thus processed in a specific manner by an assigned algorithm. A signal feature is also referred to merely as a feature for short. Examples of algorithms are noise rejection, directionality, i.e. directional effect of the microphones, frequency compression, voice emphasis and the like. Illustrative associated signal features are noise in the case of noise rejection, a sound from a specific direction in the case of directionality, the presence of specific frequency components in the case of frequency compression and the presence of an outside voice in the case of voice emphasis.

The processing by means of the algorithms might be less than optimum or at least subjectively unsatisfactory for a user of the hearing device. It is often difficult for the user himself to describe a dissatisfaction with the sound output, especially as the user typically has no detailed knowledge of the way in which the hearing device works. A description by the user to allow determination of the underlying problems by specialist personnel or by means of a database is typically also difficult, since the user often does not have the terminology for precise and clear description.

Published European patent application EP 3 468 227 A1 describes a system for processing a service request relating to an unsatisfactory output signal in a hearing device. An electronic device is configured to transmit a service request to a server upon detection of an unsatisfactorily processed output signal. The server is configured to transmit the service request and one or more initial fitting parameters of the hearing device, audiograms and/or settings of the hearing device to a computer program. The latter is configured to process the service request and to provide a response thereto, based at least in part on the one or more initial fitting parameters of the hearing device, audiograms and/or settings of the hearing device, and to transmit the response to the hearing device via the server and via the electronic device.

BRIEF SUMMARY OF THE INVENTION

Against this background, it is an object of the invention to improve the operation of a hearing system having a hearing device, and specifically the operation of a hearing device. The hearing device is intended to be set in as optimum a fashion as possible for sound output. An improved method is intended to be specified in this regard, and also a hearing system and a hearing device.

The object is achieved according to the invention by a method having the features of the independent method claim and by a hearing system or hearing device having the features of the independent hearing system claim. Advantageous configurations, developments and variants are the subject of the subclaims. The explanations associated with the method also apply mutatis mutandis to the hearing system and the hearing device, and vice versa. Where method steps of the method are described below, advantageous configurations for the hearing system and the hearing device are obtained in particular by virtue of the hearing system and hearing device being configured to perform one or more of these method steps.

A central idea of the invention is in particular the use of undifferentiated negative feedback from a user of a hearing device for improved setting of the hearing device, specifically for setting the algorithms thereof.

The method is used for operating a hearing system. The hearing system has a hearing device configured to modify an input signal for the purpose of sound output to a user and, to that end, to apply multiple algorithms with a respective potency, as a result of which a respective algorithm is applied with a present potency in a present situation. Preferably, the hearing device has at least one microphone that picks up sound from the surroundings and generates an electrical input signal. The input signal is supplied to signal processing of the hearing device, for processing, i.e. for modification. The signal processing is preferably a part of a control unit of the hearing device. The hearing device is preferably used to cater for a user with impaired hearing. To that end, the processing is in particular effected on the basis of an audiogram for the user associated with the hearing device, as a result of which an individual hearing deficiency of the user is compensated for. The audiogram is usually ascertained beforehand; this is not part of the method described here, however. The signal processing outputs an electrical output signal as result, the output signal then being converted back into sound via a receiver of the hearing device and output to the user, as a result of which a sound output is affected. Preferably, the hearing device is a binaural hearing device, having two individual devices that each have at least one microphone and a receiver and that are worn by the user on different sides of the head, namely one on or in the left ear and one on or in the right ear.

The signal processing features multiple algorithms that are preferably applied according to the present situation, i.e. depending on the situation. In principle, multiple algorithms can also be applied at the same time. A situation is also referred to as a hearing situation and is in particular characterized by background noise in the surroundings of the user and at a given time. Examples of a situation are speech, conversation, voices in the background, music, noise or various other disruptive sounds, such as ringing, clinking, whistling and the like, silence, reverberation, or combinations of these. A respective algorithm is implemented as hardware or software in the signal processing or combination thereof.

For application in a respective situation, each algorithm in particular has an adjustable potency. The potency is at least switchable between two values, e.g. on or off, but preferably adjustable to different values within a range of values, e.g. a value of between 0 and 5, the algorithm being inactive at 0, i.e. not producing an effect, and producing a stronger effect as the value increases. Which potency is used in which situation for a respective algorithm is in particular predefined, e.g. as part of a fitting session or by standard values that have been set during manufacture, or the like. An aim of the present method is in particular to find more optimum potencies for the algorithms, in particular by using feedback from the user, and thereby to improve the sound output for the user.

In an expedient configuration, each algorithm has at least one assigned signal feature and the present potency of a respective algorithm is set depending on the situation by setting the present potency on the basis of a strength of the signal feature in the input signal in the present situation. By way of example, the present potency for a respective situation is stored in a memory of the hearing device and is retrieved to apply the algorithm. The processing by the signal processing is accordingly effected on the basis of the respective strength of specific signal features in the input signal. The hearing device then reacts to the signal features in a respective situation by applying appropriate algorithms with predetermined potency, which is then accordingly a present potency in a present situation.

The signal processing operates as follows in a suitable configuration: predefined signal features are extracted from the input signal, i.e. the input signal is scanned for specific components, i.e. signal features, and these are detected if they are present. Examples of signal features have already been cited at the outset. Each algorithm has at least one assigned signal feature, so that if the signal feature is present in the input signal then the associated algorithm is applied in order to process the applicable signal feature in a specific manner and thereby to emphasize or reject it compared to the rest of the input signal, for example. The potency with which the algorithm is applied, as provided for the purpose in a present situation, is referred to as the present potency and is preferably dependent on the strength of the signal feature. The present potency is sometimes less than optimum.

In a suitable configuration, the control unit of the hearing device has an extraction unit and a combination unit in addition to the signal processing. Starting from the microphone of the hearing device, the input signal is routed along a main signal path to the combination unit and, after the latter, to the receiver for output. At the same time, the input signal is routed along a first secondary signal path, which branches off from the main signal path, to the extraction unit, in order to extract signal features. The extraction unit detects any signal features present in the input signal and identifies them, so that they can be processed by the signal processing in a specific manner. Additionally, the input signal is routed along a second secondary signal path, which likewise branches off from the main signal path, to the signal processing, for processing. The signal processing is also connected to the extraction unit, so that information relating to the signal features is transmitted from the extraction unit to the signal processing, and the signal processing can be controlled, and is controlled, such that the detected signal features are processed in a specific manner. To that end, the signal processing applies the algorithm that is assigned to a respective signal feature. As the result, the signal processing outputs a processed signal as an output signal, which is then supplied to the combination unit and is mixed by the latter with the input signal from the main path, i.e. the processed signal is applied to the input signal. The overall result of this is then an output signal that is then output via the receiver. As an alternative to the aforementioned configuration, other configurations and interconnections are also conceivable and suitable that lead to the same outcome, namely to the generation of an output signal that results from a modification of an input signal, the modification being made on the basis of those signal features that are present in the input signal, and the modification being made by means of algorithms, in order to process these signal features in a specific manner.

The hearing system is configured to recurrently receive a report from the user indicating that the user is dissatisfied with the sound output in the present situation. The receiving, i.e. the receipt, of a report in particular takes place in a first method step of the method. The dissatisfaction advantageously does not need to be explained or specified further by the user, which means that the report is undifferentiated negative feedback, i.e. a complaint or feedback that the present setting of the hearing device is perceived as inadequate, without providing a more precise indication of why or in what way. A description or characterization of the alleged shortcomings in the sound output is not required from the user. To receive a report from the user, the hearing system expediently has an input element, e.g. a switch, a button or a microphone for voice input. The input element is part of the hearing device or part of a supplementary device of the hearing system. A suitable supplementary device is in particular a mobile terminal, e.g. a smartphone. If present, the supplementary device is a part of the hearing system, but not a part of the hearing device. Operation of the input element allows a report to be generated. As already described, it is enough for a report to be sent in the first place.

Furthermore, the hearing system has a database, containing multiple weights for each algorithm, in order to rate a change of the potency, i.e. in order to rate a possible change in the value of the potency. A respective weight accordingly links two potencies to one another, to be more precise two values for the potency of an algorithm, namely the present potency to a possible future potency, or in other words an initial potency or actual potency to a target potency or possible potency. The number of weights is accordingly dependent on the number of values for the potency. By way of example, 36 weights are then obtained for an algorithm with a potency adjustable in steps of 1 in the range from 0 to 5. In other words: each pair of values from the range for the potency has an assigned weight. A respective weight rates the change from the initial potency to one of the possible target potencies. If the target potency is the same as the initial potency, the weight accordingly rates retention of this value. For a single value for the initial potency, as many weights are accordingly obtained as there are possible values for the potency. These weights for a specific potency form a weight profile or weight vector for this potency. Multiple weight profiles then form a two-dimensional weight matrix.

A respective weight is in particular a measure of the improvement that can be expected in the sound output if the present potency is retained or a different potency is used, which means that in this respect the weights are suitable for rating a change of the potency. The result of rating may be that a change is useful or that retention is more useful. Since a respective weight therefore indicates how worthwhile the use of the target potency instead of the initial potency is, the weights are also referred to as preferences, a weight profile is referred to as a preference profile and the weight matrix is referred to as a preference matrix.

If a report is received, each of the algorithms is rated by using the weights for each of the algorithms to ascertain an individual-case relevance, in order to assess the effect of a change of the potency in the present situation. This rating of the algorithms takes place in a second method step of the method. The report from the user signals that the present setting, which contains the currently used potencies, is unsatisfactory for the user, i.e. the user is dissatisfied with one or more of the currently selected potencies for the algorithms. Since the information content of the report does not go beyond the mere dissatisfaction and the user currently does not need to provide more precise details regarding the criticized or desired signal processing, it is initially unclear to which algorithms and potencies the dissatisfaction and the report relate. In other words: it is initially unclear which signal features, that is to say which components of the input signal, are not processed satisfactorily for the user. This lack of clarity is advantageously reduced in the present case by rating the algorithms, with the present potencies thereof in the present situation, on the basis of the weights. For a respective algorithm, it is in particular initially established what present potency is used in the present situation and in particular is stored therefor, e.g. in the memory of the hearing device. The weight matrix, more precisely the applicable weight profile and the weights thereof, is then used to ascertain how relevant this algorithm is to the dissatisfaction on which the report is based. In principle, the following applies: the more the weights recommend a different potency instead of the present potency, the more the applicable algorithm appears to be responsible for the dissatisfaction of the user and therefore the more relevant this algorithm is. The individual-case relevance is therefore in particular a measure of the probability of the associated algorithm being set in less-than-optimum fashion for the user. Overall, the rating of the algorithms is accordingly in particular an assessment of the respective relevance on the basis of the weights.

The individual-case relevance does not necessarily have to be calculated as part of the method. Since the individual-case relevance is preferably dependent only on the previously known weights, it is possible and advantageous to calculate all possible individual-case relevances in advance and then to look them up as required during the method. If the weights are updated, however, the individual-case relevances are usefully also recalculated. The inherently optional updating of the weights will be described in more detail later on.

The method involves multiple individual-case relevances being combined to form a relevance value for each algorithm; the relevance values are compared with one another, this is taken as a basis for selecting the most relevant algorithm, and then an adapted potency is used for the latter by adapting the present potency of the algorithm for a recommended potency determined on the basis of the weights. To adapt the present potency, this potency, which is stored, e.g. in the memory of the hearing device, as present potency for a situation, of course, is in particular replaced by a new, present potency. The ascertainment of the relevance value in particular still takes place as part of the second method step. The adaptation of the present potency and the use of the adapted potency take place in a fourth method step of the method. The determination of the recommended potency preferably takes place in the aforementioned second method step, since the weights are used in this case too. Alternatively, the determination of the recommended potency takes place in the fourth method step or in an additional, separate method step. Specifically, how the recommended potency is determined is of lesser significance for the time being; the only important thing initially is what the weights are based on, since a recommendation for a specific potency is advantageously coded in said weights, of course.

The comparison of the various relevance values, also referred to as overall ranking, and the selection of the most relevant algorithm take place in a third method step of the method. In order to combine multiple individual-case relevances, an applicable number of reports are received, since each report usually results in precisely one individual-case relevance being ascertained for a respective algorithm. A single report therefore results in one individual-case relevance being ascertained for each algorithm. These are collected over multiple reports and a relevance value is calculated for each algorithm from the individual individual-case relevances. The relevance values of the different algorithms are then in particular compared in an overall ranking in order to find the algorithm that is most relevant and therefore appears most important for the user. In this way, the algorithm that is particularly relevant to the user is identified without the user explicitly needing to provide details in this regard. The combination of multiple individual-case relevances, i.e. the use of multiple reports, in particular ensures that the correct algorithm is selected where possible and the potency thereof is adapted. The more reports are received and utilized, the higher the probability of the setting of the hearing device being adaptable satisfactorily for the user and advantageously also being adapted. Since the weights are already a rating for the different possible changes to another potency or the retention of the present potency, the weights can also advantageously be used to infer a recommendation for a new potency, i.e. a recommended potency.

The invention initially assumes—as already indicated—that a user would typically be overwhelmed in indicating precisely how the signal processing should operate and what part of the processing is unsatisfactory, let alone how the setting of the hearing device should be changed. First, the typical user lacks the vocabulary for this, and second also the knowledge of the effects and possibilities for employing specific algorithms with a specific potency in specific situations. It has also been observed that above all a new user of a hearing device often lacks the capability of expression to verbalize his or her dissatisfaction with the sound output and the resultant hearing impression such that suitable measures for changing the potencies can be inferred therefrom. Given undifferentiated statements from the user, even specialist personnel, e.g. a so-called hearing care professional, HCP for short, sometimes needs to ask questions in order to arrive at a result. Finding an improved setting is therefore correspondingly difficult.

In principle, it is conceivable to present the user with a questionnaire and to ask the user, if there is dissatisfaction with the sound output, to work through this questionnaire so as then to infer suitable measures from the responses from the user. Alternatively or additionally, it is conceivable to provide the user with free text entry and then to analyze this.

The problem of inadequate vocabulary and knowledge of the possibilities of signal processing then remains unsolved, however.

By contrast, the present method is far less complex and correspondingly simpler. As soon as the user is dissatisfied, he or she can communicate this to the hearing system by way of a simple and nonspecific report, for example a simple push of a button. It is then up to the hearing system to use multiple such reports to draw a conclusion as to what the reports probably relate to and then to ascertain, and in particular also make, suitable changes in the potencies of the algorithms by comparison. Thus, in the present case, multiple reports, i.e. multiple mentions, are taken by the hearing system as a basis for drawing a suitable conclusion as to which processing of which signal features is the reason for the dissatisfaction of the user and which potency or potencies should be set in order to avoid further dissatisfaction of the user in future. Ascertainment and in particular also use of a suitable setting mean that the user is then better placed for similar or identical situations in future; operation of the hearing system and specifically the hearing device is improved.

The method advantageously allows for the circumstance that the usefulness or disrupting influence of different signal features is typically rated subjectively and hence fundamentally differently by different users, that is to say for it being subjective which algorithm is applied in optimum fashion with which potency. Preferably, the method also allows for the surroundings of the user typically not being constant, but rather for different signal features being present at different strengths in different situations in which the user makes a report. In a given situation, e.g. within a specific space, the closer acoustic surroundings of different users are not necessarily the same. By way of example, an employee in a cafeteria is repeatedly exposed to a grinding sound of a coffee grinder, that is to say a disruptive sound, whereas a guest in the same cafeteria is exposed to the grinding sound only once, namely when queueing at the counter in order to buy a cappuccino, and is otherwise more likely repeatedly exposed to the sound of clashing crockery on a table, that is to say another disruptive sound. It is useful to apply noise rejection for the employee, but rather to apply sound smoothing for the guest, that is to say in general to apply different algorithms. Accordingly, it is assumed, and also advantageously allowed for in the method, that the intention concerning what a user wishes to hear and whether and how he wishes to hear it is sometimes very individual. By way of example, a single person in a fast food restaurant wants to watch a video displayed on a screen with the associated sound and finds himself disturbed by children's voices at the neighboring table. Conversely, the father of a family at the next table wants to hear and understand the voices of his children and is more likely to consider the video to be a disturbance. In another example, a group of people are sitting on a park bench and all except one person are involved in a lively conversation. The single person has buried himself in a novel, on the other hand, and does not wish to take part in the conversation but wants to realize if he is addressed. Finally, the method advantageously also allows for different users sometimes also having different preferences regarding the application of individual algorithms. This is frequently also dependent on the hearing deficiency of the user; for example, it has been observed that users with hearing loss of different severity reject or accept specific algorithms based on the severity of the hearing loss.

The central idea of the present method is in particular taking multiple reports from the user as a basis for performing a rating, also referred to as weighting or ranking, of the algorithms and thereby identifying the most relevant algorithm, i.e. the algorithm whose change most probably leads to improved operation and therefore to a more satisfactory sound output. This is accomplished by combining the individual-case relevances ascertained for each algorithm with every report to form a relevance value for a respective algorithm and using the relevance value to compare the respective algorithm with the other algorithms. Preferably, the algorithm that has the highest relevance value is selected as the most relevant algorithm. The individual-case relevances are each in particular assessments of what probability there is that a corresponding different potency would likely have led to a better result and would therefore possibly have prevented a report. A respective individual-case relevance is preferably greater the more probably a different potency would have led to a sound output that is satisfactory for the user.

Preferably, the database is in a form such that the strength of the signal feature assigned to a respective algorithm is taken into consideration for ascertaining the individual-case relevance and the recommended potency. The strength of a signal feature is also referred to as signal strength. The strength of the respective signal feature is preferably measured anyway in order to control the signal processing and to set the potencies of the algorithms depending on the situation, as already described above. Additionally, in the event of a report, one or more signal features are now expediently extracted from the input signal and the respective strength of said signal features is determined in order to perform an improved rating of the algorithms. To allow for the strength of a signal feature, the database suitably contains multiple weights for each particular algorithm, for different strengths of the signal feature, in each case in order to rate a change of the potency for the ascertained strength. The strength is in particular mapped to a strength range, e.g. from 0 to 5, 0 meaning that the signal feature is not present, and the strength of the signal feature increasing as the value rises. The weight matrix for a respective algorithm is therefore not merely two-dimensional, but rather three-dimensional, since the two dimensions of the initial potency and the target potency are now complemented by a third dimension for the signal strength. Accordingly, the number of weights is also increased. The rating of an individual algorithm, i.e. the ascertainment of the individual-case relevance thereof, is now effected on the basis of the strength ascertained in the present situation for the signal feature assigned to the algorithm.

The two-dimensional weight matrix for a strength 0 of a respective signal feature, i.e. when the signal feature is not contained in the input signal, is preferably an identity matrix, which means that the applicable weights indicate that if the signal feature is not present it is recommended that the present potency be retained.

As soon as the hearing system receives a report, the strengths of the signal features for the present situation are expediently measured and preferably stored. This takes place for example during the extraction of the signal features in the extraction unit. The signal features and the strengths thereof describe the present situation in particular in temporal and physical proximity to the report, i.e. the signal features denote the surroundings at the time of the report or in a specific time window around the time of the report. The strength of a respective signal feature is preferably determined in a period from no more than 10 s before the report up until the time of the report. By way of example, the signal features are extracted continuously and the respective strength thereof is buffer-stored and then used for a report in order to query the database. "Physical proximity" is in particular understood to mean "in earshot".

Which algorithms are available and used in the present case and which signal features are sought in the input signal and extracted therefrom is of lesser significance in the present case. A few suitable examples are presented below, however. One suitable algorithm is noise rejection, in order to reject disruptive sounds, e.g. machine or motor sounds. A signal feature used is for example disruptive sounds that are recognizable from the temporal and/or spectral shape thereof. Another suitable algorithm is wind noise rejection, in order to reject wind noise. This works e.g. similarly to noise rejection. A signal feature used is e.g. microphone noise. Another, similar algorithm is feedback rejection in order to reject feedback. Another algorithm is so-called sound smoothing, in order to reject impulses, i.e. brief sound signals, e.g. a spoon striking a coffee cup or the rattling of crockery. Another algorithm is directionality, i.e. a directional effect of the microphones of the hearing device, in order to emphasize sound from a specific direction. Depending on the present situation, directionality affords specific advantages. If the hearing device is intended to reproduce music in a music situation, the directionality is expediently deactivated, i.e. omnidirectional operation of the hearing device is selected, whereas if speech is present, that is to say in a speech situation, the directionality is activated, so that sound signals from in front are expediently emphasised compared with sound signals from other directions, since a relevant speaker typically stays in front of the user. Expediently, the directionality is additionally dynamically adapted in order to more efficiently reject other sound sources that are not in front but are nevertheless loud in comparison with the sound source in front of the user. A signal feature used is e.g. outside speech detected as being present. Another algorithm is compression, more precisely frequency compression, which involves in particular high frequency components in the input signal being shifted to lower frequencies in order to allow a user with a hearing deficiency in the high frequency range to nevertheless perceive these frequencies. Since e.g. fricatives are strongly represented in the high frequency range, this algorithm helps with speech intelligibility. A signal feature used is for example speech in general or specifically a high-frequency speech component, e.g. the presence of fricatives. Another algorithm is voice recognition, also referred to as voice activity detection, in order to emphasize speech. A signal feature used is e.g. the typical syllable repetition rate of 4 Hz, the presence of which then results in a speech-relevant frequency range being emphasized compared with other frequency ranges. A speech-relevant frequency range is in particular 250 Hz to 5 kHz.

A respective algorithm preferably acts selectively in respect of the associated signal feature and leaves other components of the input signal as unaltered as possible. A respective signal feature is preferably boosted (e.g. voice recognition then results in speech being boosted), added (e.g. compression, more precisely frequency compression, results in a signal being added in the low frequency range), reduced (e.g. noise rejection results in the disruptive sound being reduced) or eliminated (e.g. feedback rejection results in the feedback being completely removed or prevented) by the associated algorithm.

In a preferred configuration, a respective weight indicates what proportion of users in a reference group prefers the associated change. By way of example, a respective weight directly indicates a number of users, or the weights are additionally normalized. A respective weight is therefore in particular generated by appropriate experiments and recordings in conjunction with other users of hearing devices. By way of example, a group of test subjects and/or experienced hearing device users is considered and the behavior thereof, e.g. manual switching of the potency in specific situations, is recorded and stored as weights. A respective weight matrix then contains those proportions of users in the reference group that have changed in each case from an initial potency to a specific target potency (or have possibly retained the initial potency), in particular for a specific strength of a specific signal feature. The weights are therefore empirical data, and each weight is formed from one or more data points. A single data point is for example a single change of the potency in a single situation by a single user. In principle, it is possible and appropriate for a single user to generate multiple data points. In order to now find an optimum setting for another user, a report results in the database being checked for which potencies are preferred by the reference group and therefore recommended, as it were, for a respective algorithm when the extracted signal features are present. The recorded behavior of other users can therefore be taken as a basis for ascertaining the individual-case relevances and a recommended potency for another user.

In an advantageous configuration, the reference group comprises only users who are similar to the user, in particular users for whom a similar audiogram to that for the user was ascertained. In other words: such weights as are obtained when just the behavior of similar users is taken into consideration are used. Expediently, only such data points as can be attributed to similar users are accordingly taken into consideration. The scale used for the similarity of the user with the users in the reference group and the selection thereof is preferably the similarity of the audiograms thereof and/or of other individual features, e.g. age, sex, type of hearing deficiency, and the like. In this case it is assumed that similar users also have similar preferences and requirements in regard to the operation of the hearing device. This applies specifically to users with a similar hearing deficiency, which can be checked particularly easily on the basis of the audiograms. In this way, the entire volume of data in the database is individually reduced for each user such that particularly relevant weights are obtained and the assessment in connection with the ascertainment of the individual-case relevances becomes much more precise.

A configuration in which one or more weights are ascertained by means of an interpolation or extrapolation of weights ascertained elsewhere is also suitable. Alternatively or additionally, the weights have been stipulated by specialists, e.g. HCPs. In principle, simply an estimation of the weights, preferably in combination with an ongoing update, is also suitable for the time being. Specifically in the event of an update and the use of a reference group, the problem initially arises that weights also need to be available on day 0, which means that a simple estimation by specialists with appropriate expertise and/or a special test series with a few selected users are advantageous for initially populating the database with weights. In this context, an interpolation and/or extrapolation of the weights is also advantageous.

The recommended potency is calculated from the weights, in particular each time a report is received or once in advance. The previous explanations relating to individual-case relevance also apply, analogously, to the calculation of the recommended potency. Preferably, the recommended potency is calculated from the weights by means of a statistical evaluation, preferably a mean value formation or a median value formation. In particular, this involves using the weights of the weight profile for the present potency. Assuming a three-dimensional weight matrix, the strength of the signal feature of the associated algorithm and the present potency are accordingly taken as a basis for selecting the applicable weight profile, which contains the various weights for this strength and this potency, as initial potency, for selecting a respective target potency. These weights are then used to calculate which potency is recommended, e.g. by means of mean value or median value formation. The recommended potency calculated can match the present potency, in principle, but the associated algorithm will then be less relevant, since there is a match e.g. with the underlying reference group, of course. If there is a difference between the recommended and present potencies, however, then it can be assumed that a change to the recommended potency in the present situation would lead to an improvement. All in all, the recommended potency is a variable inferred from the database that accordingly incorporates the experiences of other users and/or the assumptions and recommendations of experts.

The individual-case relevance is a characteristic quantity for rating an algorithm, i.e. for assessing the relevance of the algorithm in the present situation for which the report has been made. In particular, the following applies: the greater the individual-case relevance of a first algorithm in comparison with the individual-case relevance of a second algorithm, the more relevant the first algorithm appears for the user in the present situation compared with the second algorithm. The same in particular also applies to the relevance value, which is inferred from the individual-case relevance, of course. A respective individual-case relevance is calculated on the basis of the weights that are stored in the database and in which in particular recommendations and/or experiences of other users and/or experts are coded. In principle, various calculation methods are advantageous. Three particularly preferred calculation methods are described below.

A first, preferred calculation method involves a respective individual-case relevance being calculated on the basis of a potency difference, which is the difference between the present potency and the recommended potency. This accordingly requires the recommended potency to likewise be ascertained, preferably as already described above. As already indicated there, it can be assumed that if the difference between the present and recommended potencies is greater then a change in the potency of the associated algorithm leads to a particularly pronounced improvement in the sound output, since the present potency differs greatly from the potency implied by the weights, of course, and therefore the potency preferred, i.e. then also recommended, by other users and/or specialists. Expediently, the absolute value of the difference is formed, so that a higher individual-case relevance is obtained for greater distance, irrespective of whether the recommended potency is above or below the present potency. Expressed as a formula, the first calculation method then yields a parameter f1 as follows:

$$f1=\text{abs}(\text{present potency}-\text{recommended potency}).$$

The individual-case relevance is then in particular proportional to the parameter f1.

A second, preferred calculation method involves a respective individual-case relevance being calculated on the basis of a change recommendation, which is a measure of the sum of the weights for changing to a different potency, on the one hand, compared with the weight for retaining the present potency, on the other. In other words: the individual-case relevance is dependent on how strongly the weights recommend a change to a different potency compared with retaining the present potency. The change recommendation is preferably normalized. Appropriately, the change recommendation formed is a difference between the sum of the weights for changing to a different potency and the weight for retaining the present potency. The weights of the weight profile for the present situation and the present potency are used in this case. For normalization, this difference is divided by the sum of all weights of this weight profile. Expressed as a formula, the second calculation method then yields a parameter f2 as follows:

$$f2=(\text{sum of all weights for a change}-\text{weight for retention})/\text{sum of all weights or reworded:}$$

$$f2=(\text{sum of all weights for which potency is not the same as present potency}-\text{weight for which potency is the same as present potency})/\text{sum of all weights for the present potency.}$$

The individual-case relevance is in particular proportional to the parameter f2. Alternatively, instead of forming the difference, it is fundamentally conceivable and appropriate to form a ratio.

A third, preferred calculation method involves a respective individual-case relevance being calculated on the basis of a measure of scatter for the present potency. The measure of scatter is in particular a measure of scatter for the target potency. The measure of scatter in particular indicates the extent to which the weights are focused on an individual potency. The measure of scatter is in particular a variance of the target potencies, each target potency being taken into consideration in accordance with the respective weight, since the weight indicates how often this target potency is preferred in comparison with the other target potencies. This is particularly illustrative if the weights simply each indicate a number of users, since a weight pertaining to a specific data pair comprising initial potency and target potency then simply yields the number of data points for this data pair. These data points are then statistically evaluated, e.g. by calculating the variance thereof as a measure of scatter, as described, the initial potency then being the same for each data point, in order merely to consider a specific weight profile, namely that of the present potency.

Accordingly, it is possible to read from the measure of scatter how strongly a specific potency is recommended or whether multiple potencies are more likely possible, ultimately that is to say how pronounced the recommendation on the basis of the database is. The higher a respective weight, the more data points recommend the associated target potency. A respective data point corresponds e.g. to a user or, specifically in the case of normalized weights, a specific number of users. The measure of scatter is expediently inverted, which means that a low measure of scatter yields a high individual-case relevance and therefore makes an algorithm appear all the more relevant. A suitable formula for the third calculation method, which then yields a parameter f3, is as follows:

$$f3=\exp(1/\exp(\text{sqr}(V))),$$

where "exp" denotes the exponential function with base e, "sqr" is a square root and "V" is a variance of the target potency of the relevant weight profile and is calculated as follows, for example:

$$V=(1/n)*\text{sum}(x_i-M(x))\hat{}2,$$

where x_i are the target potencies and M(x) is a mean value or median of the potency, i.e. target potency here, and where all n data points of the weight profile are used for summation. The individual-case relevance is then in particular proportional to the parameter f3.

A combination of multiple calculation methods is particularly preferred, with the result that the individual-case relevance combines various concepts. A particularly preferred configuration is one in which all three of the aforementioned calculation methods are combined and a respective individual-case relevance R_e is proportional to the product of the cited three parameters f1, f2, f3 and e.g. corresponds to this product, with the result that $$R_e=f1*f2*f3.$$

The relevance value of a respective algorithm is preferably calculated by means of a statistical evaluation, preferably a median value formation, from the individual-case relevances of this algorithm, i.e. in particular in a similar manner to that described above for the recommended potency. In this way, multiple individual-case relevances of an individual algorithm are combined in order to effectively assess the relevance thereof in the overall ranking with other algorithms. Typically, higher individual-case relevances also yield a higher relevance value. Preferably, the relevance value is recalculated for each report and thereby advantageously continually updated, i.e. in particular the relevance value as a whole is ascertained iteratively.

The effect achievable and in particular also achieved by the method, in principle, will be explained below with the aid of an example, using the various algorithms described and the explanations above with two different users of hearing devices in a cafeteria. The user, who is an employee and is repeatedly disturbed by the coffee grinder, will repeatedly operate the input element at the sound of the coffee grinder and thereby generate a report, whereas the guest, sitting at the table, will repeatedly generate a report at the sound of rattling crockery. Accordingly, in the former case, the noise rejection algorithm will achieve a higher relevance value over time in order to reject the sound of the coffee grinder. This appears to be most relevant for the applicable user. Conversely, in the case of the guest, a sound smoothing algorithm is detected as the most relevant algorithm over time in order to reject the crash of crockery. The same method therefore individually leads to an optimum setting. A prerequisite is the applicable storage of weights in the database. These contain the information, in appropriately coded form, that most users prefer sound smoothing in the case of the "sound of rattling crockery" or "impulse" signal feature, which means that the potency of the sound smoothing is adapted for the guest as appropriate, in the present case presumably increased, following repeated reporting. Furthermore, the weights contain the information that most users prefer noise rejection in the case of the "noise" signal feature, which is generated by the coffee grinder, and so the potency of the noise rejection is adapted for the employee as appropriate, in the present case presumably increased, following repeated reporting. The aforementioned example is merely one of many conceivable and possible situations and is used primarily to illustrate the way in which the method works.

From the above, it also becomes clear that a single report is typically not sufficient to identify and adapt one of the algorithms as the most relevant algorithm with satisfactory probability. In a preferred configuration, the present potency of the most relevant algorithm is adapted for the recommended potency only when the relevance value of the most relevant algorithm differs from the relevance values of the other algorithms by at least a minimum value. Accordingly, a period of time is waited until a distinction defined as sufficient above the minimum value is reached and one of the algorithms is distinguished with sufficient certainty from the other algorithms. Expediently, the first, second and third method steps are therefore carried out multiple times. The third method step is then followed by a checking step in which compliance with the minimum value is checked, and if the compliance turns out to be positive then the fourth method step is carried out. The minimum value is in particular a minimum required difference between the highest relevance value and the next highest relevance value. An additional significance check is therefore performed, i.e. in addition to the check on which algorithm has the highest relevance value there is also a further check to determine whether this relevance value is also sufficiently different than the other relevance values.

Expediently, the weights in the database are updated on the basis of the adapted potency and the adapted potency is therefore taken into consideration from then on for ascertaining an individual-case relevance and a recommended potency. The database is therefore advantageously continually updated. The knowledge from the application of the method for an individual user therefore also benefits other users whose hearing systems likewise use the database. The adapted potency as target potency in combination with the original, present potency in the associated present situation correspond to the coordinates of a data point in the weight matrix, the associated weight of which data point is now increased, since following adaptation of the potency for the user this adaptation can now be assumed, and also is assumed, to be advisable. Equivalently, the other weights can also be reduced. If the database continues to be used by the hearing system of the user or another user, the updated weights are then used. In this respect, the database is a continually updated system or even a learning system.

In a suitable configuration, the adapted potency used is simply the recommended potency. Alternatively, an intermediate value is formed, for example the mean value from the present and recommended potencies, in order to achieve an adaptation for the recommended potency.

Preferably, the adapted potency is used as the new, present potency from then on, and so the adapted potency is automatically used when the present situation arises again. The adapted potency is thus set directly by the hearing system and is then the potency that is used in future when an applicable situation arises. Should a report then still be made again, the method is continued as already described in order to obtain a further adaptation thereof or of another algorithm.

As an alternative to the previously described, direct application of the adapted potency, a suitable configuration involves the adapted potency being proposed to the user in a test mode initially and being used as the new present potency only after a confirmation by the user. The test mode is therefore used for test hearing, as it were. The user is therefore provided with the opportunity to test the adapted potency beforehand and then either to accept it or to reject it. This is made possible by way of appropriate input elements, e.g. on the hearing device or on a supplementary device. Only if the adapted potency was accepted by the user in the test mode by means of an appropriate input is the adapted potency then actually used and stored as the new present potency as already described, and preferably also only then is an update for the weights in the database performed.

In principle, it is possible for the update for the weights to result in the data in the database being constricted, since the respective update is performed on the basis of the previous weights, of course. In this respect, there sometimes arises an inclination for the existing weights to tend to be confirmed. A previously high weight is increased further. To prevent this, an advantageous configuration involves a different, experimental potency occasionally being proposed in the test mode instead of an adapted potency. By way of example, "occasionally" is understood to mean "in 1 to 10 of 100 cases". The user is thus deliberately not offered the potency adapted on the basis of the method, but rather is intentionally offered a different and possibly less optimum potency. If the experimental potency is then nevertheless satisfactory for the user, he will accept the experimental potency, and so the potency is used as the new present potency by the hearing system from then on. The weights in the database are also updated on the basis of the experimental potency, and the potency is therefore taken into consideration from then on for ascertaining an individual-case relevance and a recommended potency. In an advantageous variant, the experimental potency is used to update the weights only if at least one or a minimum number of further users have likewise accepted the applicable adaptation. The experimental potency is intentionally chosen as a departure from the recommended potency, which means that a constriction of the previous data in the database is avoided. The experimental potency is chosen to be higher or lower than the recommended potency, for example, or is a random value. The experimental potency is preferably proposed for the most relevant algorithm; alternatively, however, it is also advantageous to propose an experimental potency for a different algorithm, that is to stay to adapt the potency for a different algorithm instead of the algorithm that is actually most relevant. A combination is also expedient. Preferably, an experimental potency is offered only to specific users, e.g. users that have explicitly declared themselves prepared for this in advance. Such users are also referred to as users happy to experiment.

A hearing system or hearing device according to the invention is configured to carry out a method as described above. Preferably, the hearing system or the hearing device has a control unit, also referred to as a controller, for this purpose. The method is implemented in the control unit in particular by programming or by circuitry, or a combination of these. By way of example, for this purpose the control unit is in the form of a microprocessor or in the form of an ASIC, or in the form of a combination of these. The control unit can also be split over different devices of the hearing system and is not necessarily identical to the aforementioned control unit of the hearing device. In principle, the method steps just described can be split over different devices largely as desired.

The hearing system contains at least one hearing device and a database as described above. The hearing device is connected to the database by way of a data connection, e.g. via the Internet, for the purpose of data interchange. The database is expediently a part of a server, which is accordingly a part of the hearing system. A particularly expedient configuration is one in which the hearing system also comprises a supplementary device, in particular a mobile terminal, that is individually associated with the individual user, preferably a smartphone. The supplementary device is used as a mediator between the hearing device and the server and to connect these for the purpose of data interchange. The hearing device and the supplementary device are preferably connected by way of a Bluetooth connection for the purpose of data interchange, whereas the supplementary device and the database are preferably connected via the Internet. Other data connections and combinations of data connections are conceivable and likewise suitable in principle, however. A configuration in which the database is a part of the supplementary device or even of the hearing device, so that the hearing device manages even without a server, is also suitable. The described configuration with the supplementary device and the server is particularly preferred, however.

The individual-case relevances are preferably calculated on the server and therefore advantageously centrally, which means that the calculation can easily be updated, e.g. by the manufacturer of the hearing device, which expediently also operates the server. By contrast, the relevance values are preferably calculated on the supplementary device or on the hearing device, that is to say close to the user. The calculation of the individual-case relevances is initially dependent only on the weights, in principle, and in this respect is user-dependent and also able to be carried out in advance. However, the calculation of the relevance values is dependent on the reports by the user and is also dependent on the present situations experienced by the user, and in this respect is individual. Calculation of the relevance values on the supplementary device or on the hearing device thus means that these individual data do not need to be transmitted and do not need to be processed centrally, which would be correspondingly complex.

Other features which are considered as characteristic for the invention are set forth in the appended claims.

Although the invention is illustrated and described herein as embodied in a method for operating a hearing system, a hearing system and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
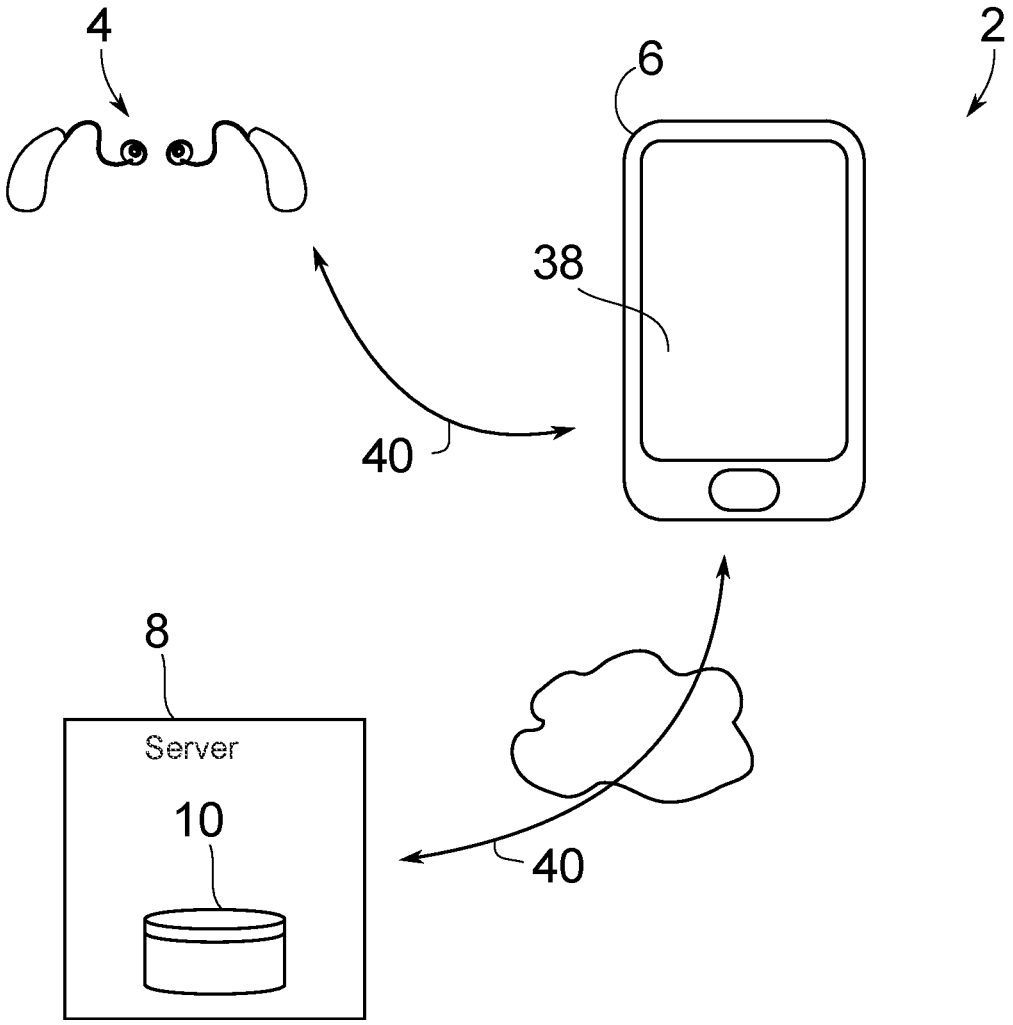
FIG. 1 is an illustration showing a hearing system according to the invention.
Figure 2:
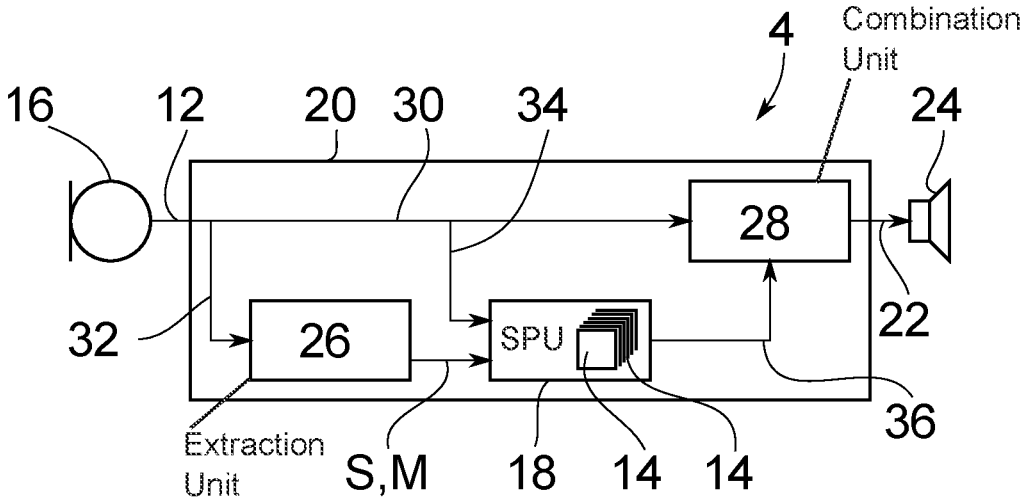
FIG. 2 is a block diagram of a hearing device.

Referring now to the figures of the drawings in detail and first, particularly to FIG. 1 thereof, there is shown an exemplary embodiment of a hearing system 2 that has a hearing device 4, and also a supplementary device 6 and a server 8 with a database 10. The hearing device 4 is shown schematically in FIG. 2. The hearing device 2 is configured to modify an input signal 12 for the purpose of sound output to a user, who is not shown explicitly, and, to that end, to apply multiple algorithms 14 with a respective potency (effectiveness) W, as a result of which a respective algorithm 14 is applied with a present potency aW in a present situation. The hearing device 4 shown has at least one microphone 16 that picks up sound from the surroundings and generates the electrical input signal 12. The input signal is supplied to signal processing 18 of the hearing device 4, for processing, i.e. for modification. The signal processing 18 is a part of a control unit 20 of the hearing device 4. The hearing device 4 is used here to cater for a user with impaired hearing. To this end, the processing is affected on the basis of an audiogram for the user associated with the hearing device 4, as a result of which an individual hearing deficiency of the user is compensated for. The signal processing 18 outputs an electrical output signal 22 as result, the output signal then being converted back into sound via a receiver 24 of the hearing device 4 and output to the user, as a result of which a sound output is affected. The hearing device 4 shown in FIG. 1 is a binaural hearing device 4, having two individual devices that each have at least one microphone 16 and a receiver 24 and that are worn by the user on different sides of the head. FIG. 2 shows just one of the individual devices in simplified fashion.

The signal processing 18 features multiple algorithms 14 that are preferably applied according to the present situation, i.e. depending on the situation, multiple algorithms 14 also being able to be applied simultaneously. For application in a respective situation, each algorithm 14 has an adjustable potency W, as already indicated above. The potency W is e.g. a value of between 0 and 5, the algorithm 14 being inactive at 0, i.e. not producing an effect, and producing a stronger effect as the value increases. Which potency W is used in which situation for a respective algorithm 14 is predefined. The method now attempts to find more optimum potencies W for the algorithms 14 and to adapt the predefined potencies W in suitable fashion.

Each algorithm 14 has at least one assigned signal feature M and the present potency aW of a respective algorithm 14 is set depending on the situation by setting the present potency on the basis of a strength S of the signal feature M in the input signal 12 in the present situation. The processing by the signal processing 18 is accordingly effected on the basis of the respective strength S of specific signal features M in the input signal 12. The hearing device 4 then reacts to the signal features M in a respective situation by applying appropriate algorithms 14 with predetermined potency W, which is then accordingly a present potency aW in a present situation. In the present case, a respective algorithm 14 acts selectively in respect of the associated signal feature M and leaves other components of the input signal 12 as unaltered as possible. A respective signal feature M is boosted or reduced by the associated algorithm 14, for example.

Which algorithms 14 are available and used and which signal features M are sought in the input signal 12 and extracted therefrom is of lesser significance. Examples of algorithms 14 are noise rejection, in order to reject disruptive sounds, e.g. machine or motor sounds, as signal feature M, wind noise rejection, in order to reject wind noise, with microphone noise as signal feature M, feedback rejection, sound smoothing, in order to reject impulses as signal feature M, directionality, i.e. a directional effect of the microphones 16, in order to emphasize sound from a specific direction, compression, specifically frequency compression, and voice recognition, in order to emphasize speech.

The signal processing 18 according to the exemplary embodiment in FIG. 2 operates as follows: predefined signal features M are extracted from the input signal 12. If an applicable signal feature M is present, the associated algorithm 14 is applied in order to process the applicable signal feature M in a specific manner and thereby to emphasize or reject it compared to the rest of the input signal 12, for example. The potency W with which the algorithm 14 is applied, as provided for said purpose in a present situation, is referred to as the present potency aW and is here dependent on the strength S of the signal feature M. The present potency aW is sometimes less than optimum.

The hearing device 4 shown has an extraction unit 26 and a combination unit 28 in addition to the signal processing 18. Starting from the microphone 16 of the hearing device 4, the input signal 12 is routed along a main signal path 30 to the combination unit 28 and, after the latter, to the receiver 24 for output. At the same time, the input signal 12 is routed along a first secondary signal path 32, which branches off from the main signal path 30, to the extraction unit 26, in order to extract signal features M. The extraction unit 26 detects any signal features M present in the input signal 12 and identifies them, so that they can be processed by the signal processing 18 in a specific manner. The extraction unit 26 here also measures the strength S of a respective signal feature M. Additionally, the input signal 12 is routed along a second secondary signal path 34, which likewise branches off from the main signal path 30, to the signal processing 18, for processing. The signal processing 18 is also connected to the extraction unit 26, so that information relating to the signal features M is transmitted from the extraction unit 26 to the signal processing 18, and the signal processing 18 can be controlled, and is controlled, such that the detected signal features M are processed in a specific manner. To that end, the signal processing 18 applies the algorithm 14 that is assigned to a respective signal feature M. As the result, the signal processing 18 outputs a processed signal 36 as an output signal, which is then supplied to the combination unit 28 and is mixed by the latter with the input signal 12 from the main path 30, i.e. the processed signal 36 is applied to the input signal 12. The overall result of this is then an output signal 22 that is output via the receiver 24. As an alternative to this configuration shown in FIG. 2, other configurations and interconnections are also conceivable and suitable.

Figure 3:
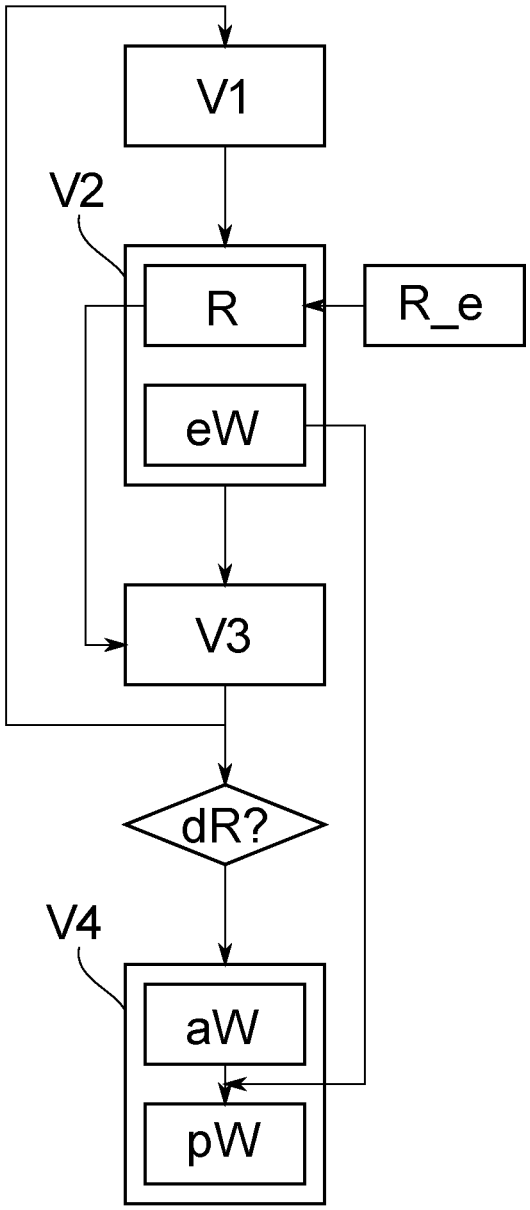
FIG. 3 is a flow chart for explaining a method according to the invention.

FIG. 3 shows a flowchart for an exemplary embodiment of a method according to the invention for operating the hearing system 2. The method is effectively used for improved setting of the hearing device 4 and in this respect also for operating the hearing device 4.

The hearing system 2 is configured to recurrently receive a report from the user indicating that the user is dissatisfied with the sound output in the present situation. The receiving, i.e. the receipt, of a report here takes place in a first method step V1 of the method. The dissatisfaction does not need to be explained or specified further by the user, which means that the report is undifferentiated negative feedback. To receive a report from the user, the hearing system 2 has an input element 38, here on the supplementary device 6, alternatively or additionally at another location, e.g. on the hearing device 4. The supplementary device 6 shown here is a mobile terminal, specifically a smartphone. A report can be generated by operating the input element 38.

Figure 4:
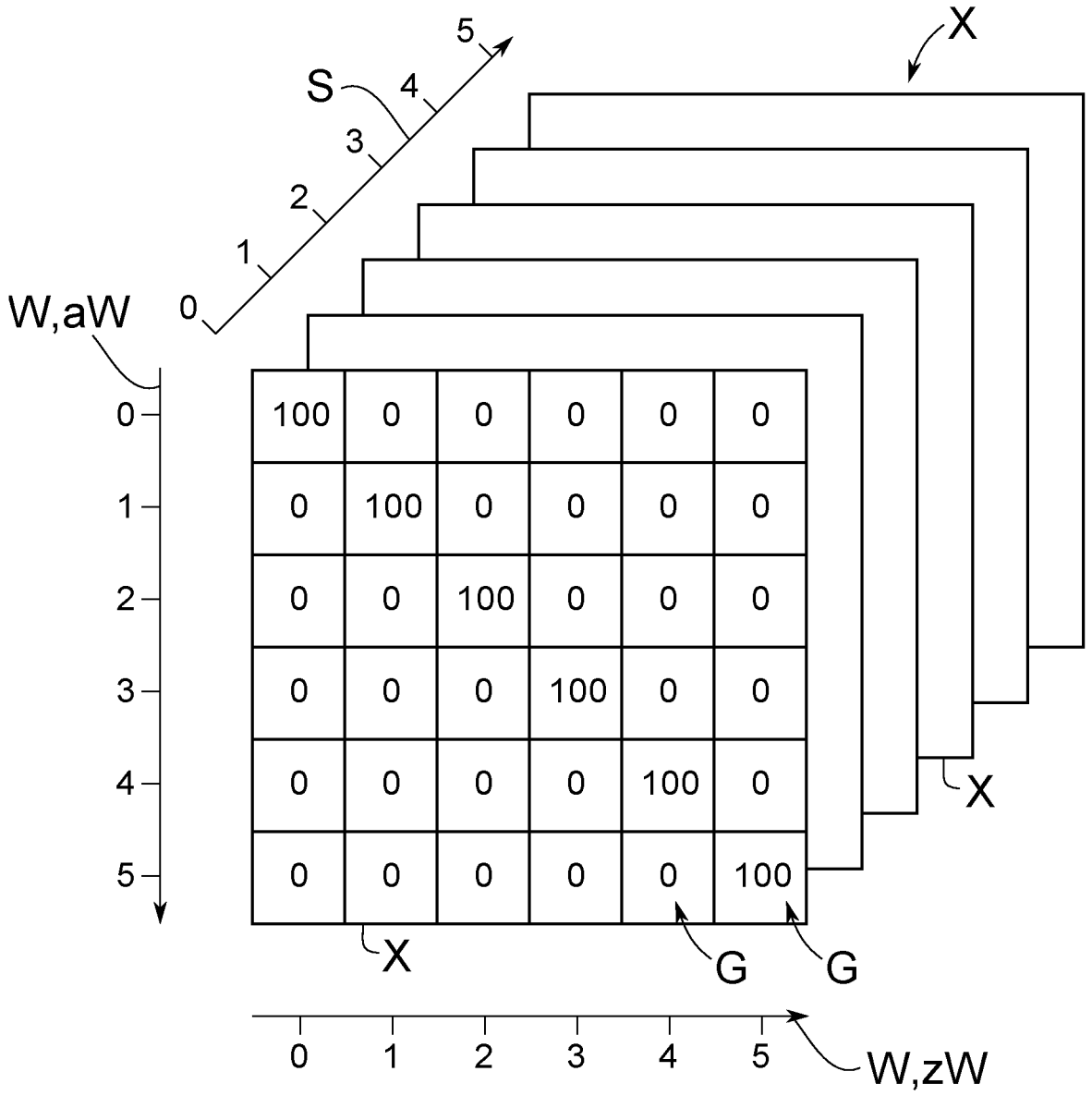
FIG. 4 is an illustration showing a three-dimensional weight matrix.
Figure 5:
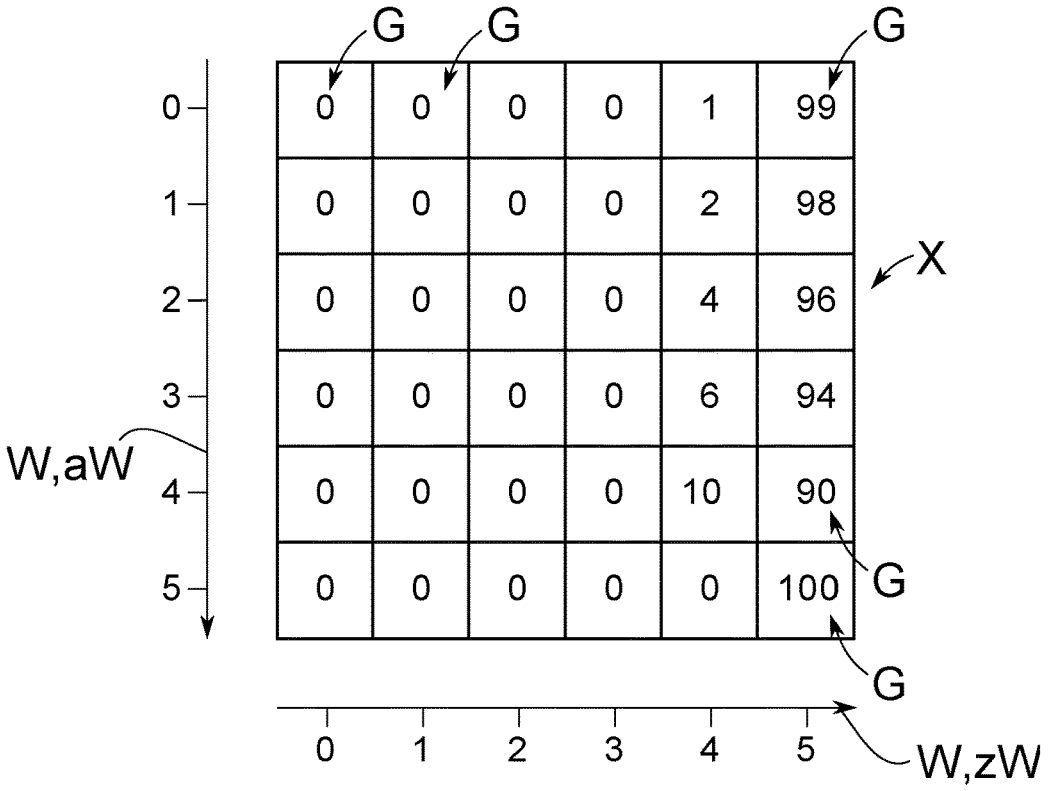
FIG. 5 is an illustration showing an excerpt from the weight matrix from FIG. 4.
Figure 6:
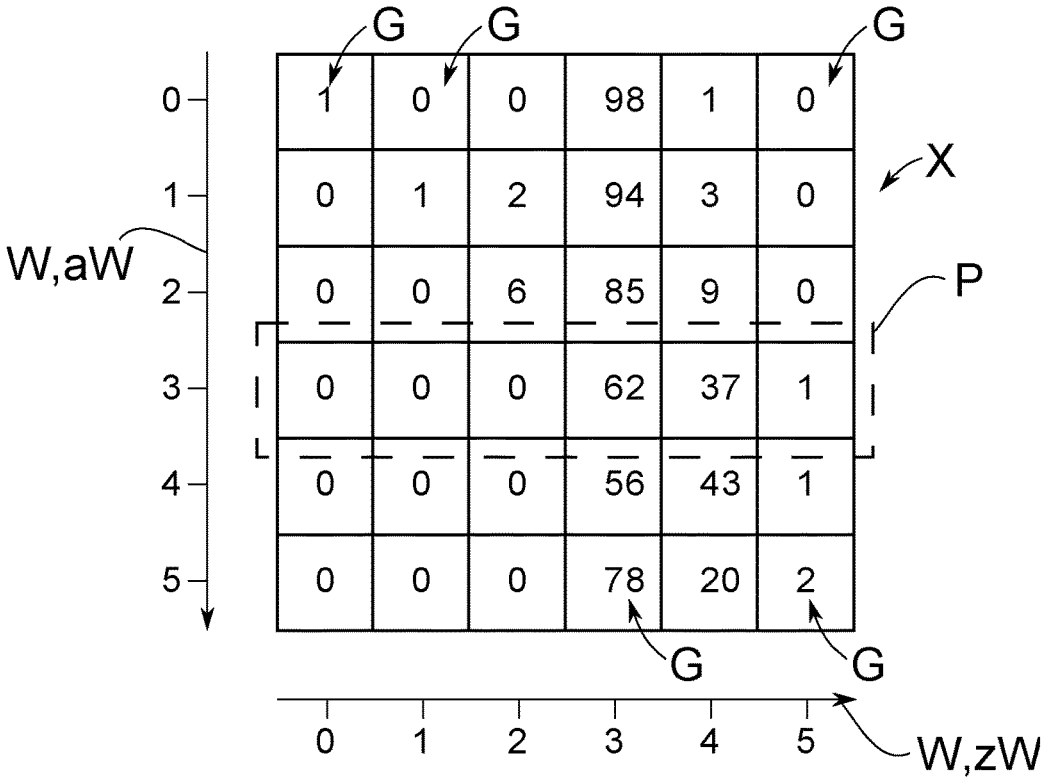
FIG. 6 is an illustration showing a further excerpt from the weight matrix from FIG. 4.

Furthermore, as can be seen in FIG. 1, the hearing system 2 has a database 10. Said database contains multiple weights G for each algorithm 14, in order to rate a change of the potency W, i.e. in order to rate a possible change in the value of the potency W. Illustrative weights G are indicated in FIGS. 4-6. A respective weight G accordingly links two potencies W to one another, to be more precise two values for the potency W of an algorithm 14, namely the present potency aW to a possible future potency, or in other words an initial potency aW or actual potency to a target potency zW or possible potency. The number of weights G is accordingly dependent on the number of values for the potency W. In the exemplary embodiment shown, 36 weights are then obtained for an algorithm 14 with a potency W adjustable in steps of 1 in the range from 0 to 5. A respective weight G rates the change from the initial potency aW to one of the possible target potencies zW. If the target potency zW is the same as the initial potency aW, the weight G accordingly rates retention of this value. For a single value for the initial potency aW, as many weights G are accordingly obtained as there are possible values for the potency W. These weights G for a specific potency W form a weight profile P or weight vector for this potency W. An illustrative weight profile P is marked in FIG. 6. Multiple weight profiles P then form a two-dimensional weight matrix X, as can be seen in FIGS. 4-6. A respective weight G is a measure of the improvement that can be expected in the sound output if the present potency aW is retained or a different potency W is used, which means that in this respect the weights G are suitable for rating a change of the potency G. The result of rating may be that a change is useful or that retention is more useful. Since a respective weight G therefore indicates how worthwhile the use of the target potency zW instead of the initial potency aW is, the weights G are also referred to as preferences, a weight profile P is referred to as a preference profile and the weight matrix X is referred to as a preference matrix.

If a report is received, each of the algorithms 14 is rated by using the weights G for each of the algorithms 14 to ascertain an individual-case relevance R_e, in order to assess the effect of a change of the potency in the present situation. The individual-case relevance R_e is ascertained by looking it up or calculating it, for example. This rating of the algorithms takes place in a second method step V2 of the method. The report from the user signals that the present setting, which comprises the currently used potencies aW, is unsatisfactory for the user, i.e. the user is dissatisfied with one or more of the currently selected potencies aW for the algorithms 14. Since the information content of the report does not go beyond the mere dissatisfaction and the user currently does not need to provide more precise details regarding the criticized or desired signal processing, it remains unclear to which algorithms 14 and potencies W the dissatisfaction and the report relate. For a respective algorithm 14, it is initially established what present potency aW there is in the present situation. The weight matrix X, more precisely the applicable weight profile P and the weights G thereof, is then used to ascertain how relevant this algorithm 14 is to the dissatisfaction on which the report is based. In principle, the following applies: the more the weights G recommend a different potency W instead of the present potency aW, the more the applicable algorithm 14 appears to be responsible for the dissatisfaction of the user and therefore the more relevant this algorithm 14 is. The individual-case relevance R_e is therefore in particular a measure of the probability of the associated algorithm 14 being set in less-than-optimum fashion for the user. The individual-case relevance R_e does not necessarily have to be calculated as part of the method. Since the individual-case relevance R_e is dependent only on the previously known weights G in the present case, it is possible to calculate all possible individual-case relevances R_e in advance and then to look them up as required during the method.

The method involves multiple individual-case relevances R_e being combined to form a relevance value R for each algorithm 14; the relevance values R are compared with one another, this is taken as a basis for selecting the most relevant algorithm 14, and then an adapted potency pW is used for the latter by adapting the present potency aW of the algorithm 14 for a recommended potency eW determined on the basis of the weights G. The individual-case relevances R_e are each assessments of the probability of an applicable other potency W being likely to have led to a better result and therefore possibly to have prevented a report. In the present case, a respective individual-case relevance R_e is all the greater the more probable it is that another potency W would have led to a satisfactory sound output for the user. The relevance value R is also ascertained as part of the second method step V2. The adaptation of the present potency aW and the use of the adapted potency pW take place in a fourth method step V4 of the method. The determination of the recommended potency eW takes place in the second method step V2 here, since this also involves the weights G being used, but determination at another point is likewise possible and appropriate.

The comparison of the various relevance values R, also referred to as overall ranking, and the selection of the most relevant algorithm 14 take place in a third method step V3 of the method. In order to combine multiple individual-case relevances R_e, an applicable number of reports are received, since each report usually results in precisely one individual-case relevance R_e being ascertained for a respective algorithm 14. These are collected over multiple reports and a relevance value R is calculated for each algorithm 14 from the individual individual-case relevances R_e. The relevance values R of the different algorithms 14 are then compared in an overall ranking in order to find the algorithm 14 that is most relevant and therefore appears most important for the user. In the present case, the algorithm 14 that has the highest relevance value R is selected as the most relevant algorithm 14. In this way, the algorithm 14 that is particularly relevant to the user is identified without the user explicitly needing to provide details in this regard. The more reports are received and utilized, the higher the probability of the setting of the hearing device 4 being adaptable satisfactorily for the user and then also being directly adapted, for example. Since the weights G are already a rating for the different possible changes to another potency W or the retention of the present potency aW, the weights G can also be used to infer a recommendation for a new potency, i.e. a recommended potency eW.

The database 10 in FIG. 1 is in a form such that the strength S of the signal feature M assigned to a respective algorithm 14 is taken into consideration for ascertaining the individual-case relevance R_e and the recommended potency eW. In the present case, the strength S of the respective signal feature M is measured anyway, for example in the extraction unit 26, in order to control the signal processing 18 and to set the potencies W of the algorithms 14 depending on the situation, as already described above. Additionally, in the event of a report, one or more signal features M are now extracted from the input signal 12 and the respective strength S of the signal features is determined. To allow for the strength S of a signal feature M, the database 10 contains multiple weights G for each particular algorithm 14, for different strengths S of the signal feature M, in each case in order to rate a change of the potency W for the ascertained strength S. This can be seen in FIG. 4, which shows a three-dimensional weight matrix X for an individual algorithm 14, with illustrative weights G, a two-dimensional weight matrix X being present as a partial matrix for each strength S of the associated signal feature M.

The strength S is mapped to a strength range, e.g. from 0 to 5, 0 meaning that the signal feature M is not present, and the strength S of the signal feature M increasing as the value rises. The weight matrix X for a respective algorithm 14 is therefore not merely two-dimensional, but rather three-dimensional, since the two dimensions of the initial potency aW and the target potency zW are now complemented by a third dimension for the strength S. Accordingly, the number of weights G is also increased. The rating of an individual algorithm 14, i.e. the ascertainment of the individual-case relevance R_e thereof, is now effected on the basis of the strength S ascertained in the present situation for the signal feature M assigned to the algorithm 14.

FIGS. 5 and 6 each show an excerpt from the three-dimensional weight matrix X from FIG. 4. As such, FIG. 5 shows the two-dimensional weight matrix X for a strength S of 5, i.e. a very strong signal feature M, and FIG. 6 shows the two-dimensional weight matrix X for a strength S of 3, i.e. a medium-strength signal feature M. The values shown for the weights G are example values, which, however, clarify the tendency to change to a greater potency W at a greater strength S. FIG. 4 also reveals that the two-dimensional weight matrix X for a strength S of 0, i.e. when the signal feature M is not contained in the input signal 12, is an identity matrix, which means that the applicable weights G indicate that if the signal feature M is not present it is recommended that the present potency aW be retained.

In the exemplary embodiment shown in FIGS. 4-6, a respective weight G indicates what proportion of users in a reference group prefers the associated change. In the present case, a respective weight G is generated by appropriate experiments and recordings in conjunction with other users of hearing devices 4. A respective weight matrix X then contains those proportions of users in the reference group that have changed in each case for a specific strength S of a specific signal feature M and from an initial potency aW to a specific target potency zW (or have possibly retained the initial potency aW). In FIGS. 4-6, the weights G of a respective weight profile P are normalized such that the sum thereof yields 100. A report then results in the database 10 being checked for which potencies W are preferred by the reference group and therefore recommended, as it were, for a respective algorithm 14 when the extracted signal features M are present. The recorded behavior of other users can therefore be taken as a basis for ascertaining the individual-case relevances R_e and a recommended potency eW for another user.

The reference group contains only users who are similar to the user, for example, in particular users for whom a similar audiogram to that for the user was ascertained. The scale used for the similarity of the user with the users in the reference group and the selection thereof is for example the similarity of the audiograms thereof and/or of other individual features, e.g. age, sex, type of hearing deficiency, and the like. In this case it is assumed that similar users also have similar preferences and requirements in regard to the operation of the hearing device.

The recommended potency eW is calculated from the weights G whenever a report is received or once in advance and possibly again when the weights G are updated. In the present case, the recommended potency eW is calculated from the weights G by means of a statistical evaluation, e.g. a mean value formation or a median value formation. This involves using the weights G of the weight profile P for the present potency aW. Assuming a three-dimensional weight matrix X, e.g. as in FIG. 4, the strength S of the signal feature M of the associated algorithm 14 and the present potency aW are taken as a basis for selecting the applicable weight profile P, which contains the various weights G for this strength S and this potency W, as initial potency aW, for selecting a respective target potency zW. By way of example, the strength S is 3, which means that the two-dimensional weight matrix X from FIG. 6 is used. The present potency aW is likewise 3, for example, which means that the marked weight profile P is selected in FIG. 6. These six weights G in conjunction with the possible potencies W are then used to calculate which potency W is recommended, e.g. by means of mean value or median value formation. By way of example, a respective target potency zW is multiplied by the associated weight G and therefore weighted; the target potencies zW weighted in this manner are then added and/or divided by the sum of the weights G, here 100. In the example, the potency W obtained is then 3.42, which is additionally rounded to a recommended potency eW of 3, for example. The recommended potency eW calculated can match the present potency aW, in principle, but the associated algorithm 14 will then be less relevant, since there is a match e.g. with the underlying reference group, of course. If there is a difference between the recommended potency eW and the present potency aW, however, then it can be assumed that a change to the recommended potency eW in the present situation would lead to an improvement. This is the case for example if the present potency aW is 0 in FIG. 6. The recommended potency eW obtained is again 3, which then differs from the initial potency aW 0.

The individual-case relevance R_e is a characteristic quantity for rating an algorithm 14 in the present situation for which the report has been made. The following applies: the greater the individual-case relevance R_e of a first algorithm 14 in comparison with the individual-case relevance R_e of a second algorithm 14, the more relevant the first algorithm 14 appears for the user in the present situation compared with the second algorithm 14. The same also applies to the relevance value R, which is inferred from the individual-case relevance R_e. A respective individual-case relevance R_e is calculated on the basis of the weights G that are stored in the database 10 and in which in particular recommendations and/or experiences of other users and/or experts are coded. In principle, various calculation methods are possible and appropriate individually or in combination.

A first calculation method involves a respective individual-case relevance R_e being calculated on the basis of a potency difference, which is the difference between the present potency aW and the recommended potency eW. In the present case, the absolute value of the difference is also formed, so that a higher individual-case relevance R_e is obtained for greater distance, irrespective of whether the recommended potency eW is above or below the present potency aW. Expressed as a formula, the first calculation method then yields a parameter f1 as follows:

$$f1 = \text{abs}\,(\text{present potency } aW - \text{recommended potency } eW).$$

For the aforementioned example with the present potency aW of 3 in FIG. 6, f1=0 is then obtained, provided that the recommended potency eW is rounded. On the other hand, if the present potency aW is 7, for example, then the recommended potency eW obtained from FIG. 6 is likewise 3 and therefore f1=3.

The adapted potency pW used is simply the recommended potency eW, for example. Alternatively, for example an intermediate value is formed, e.g. the mean value from the present potency aW and the recommended potency eW, in order to achieve an adaptation for the recommended potency eW.

A second calculation method involves a respective individual-case relevance R_e being calculated on the basis of a change recommendation, which is a measure of the sum of the weights G for changing to a different potency W, on the one hand, compared with the weight G for retaining the present potency aW, on the other. In the present case, the change recommendation formed is a normalized difference between the sum of the weights G for changing to a different potency W and the weight G for retaining the present potency aW. The weights G of the weight profile P for the present situation and the present potency aW are used in this case. For normalization, this difference is divided by the sum of all weights G of this weight profile P. Expressed as a formula, the second calculation method then yields a parameter f2 as follows:

$$f2=(\text{sum of all weights } G \text{ for a change}-\text{weight } G \text{ for retention})/\text{sum of all weights } G.$$

When applied to the weight profile P marked in FIG. 6, by way of illustration, the sum of the weights G for changing to a different potency W accordingly yields 0+0+0+37+1=38. The weight G for retaining the present potency aW is 62. The difference is then 38−62=−24, and, when normalized, f2=−0.24 is then obtained. By contrast, f2=(99−1)/100=0.98 is then obtained from FIG. 6 for a present potency aW of 0.

A third calculation method involves a respective individual-case relevance R_e being calculated on the basis of a measure of scatter of the target potency zW for the present potency aW. The measure of scatter indicates the extent to which the weights G are focused on an individual potency W. The measure of scatter is for example a variance of the target potencies zW. If the weights G simply each indicate a number of users, a weight G pertaining to a specific data pair containing initial potency aW and target potency zW simply yields the number of data points for this data pair. These data points are then statistically evaluated. It is possible to read from the measure of scatter how strongly a specific potency W is recommended or whether multiple potencies W are possible, ultimately that is to say how pronounced the recommendation on the basis of the database 10 is. The higher a respective weight G, the more data points recommend the associated target potency zW. The measure of scatter is inverted in the present case, which means that a low measure of scatter yields a high individual-case relevance R_e and therefore makes an algorithm 14 appear all the more relevant. A suitable formula for the third calculation method, which then yields a parameter f3, is as follows:

$$f3=\exp\ (1/\exp(\mathrm{sqr}(V))),$$

where "exp" denotes the exponential function with base e, "sqr" is a square root and "V" is a variance of the target potency zW of the relevant weight profile P and is calculated as follows, for example:

$$V=(1/n)*\mathrm{sum}(x_i-M(x))\hat{}2,$$

where x_i are the target potencies zW and M(x) is a mean value or median of the potency W, i.e. target potency zW here, and where all data points of the weight profile P are used for summation. In the example in FIG. 4-6, M(x) is e.g. the mean value of the potencies W and is then 2.5. The weight profile P is formed from 100 data points in accordance with the sum of the weights, i.e. n=100. In FIG. 6, the data pair (initial potency aW=3; target potency zW=3) occurs, by way of illustration, 62 times for the marked weight profile P of the initial potency 3, that is to say that 62 data points (3; 3) are present. This results in a variance V=1.05 and accordingly f3=1.43. By contrast, V=0.29 and f3=1.79 is accordingly obtained for the initial potency 0 in FIG. 6, that is to say a lower measure of scatter and hence a higher individual-case relevance R_e.

In the present case, the three aforementioned calibration methods are combined by multiplying the parameters f1, f2, f3 in order to obtain the individual-case relevance R_e:

$$R_e=f1*f2*f3.$$

This is carried out for each of the algorithms 14, as a result of which an individual-case relevance R_e is ascertained for each algorithm 14 for the present situation.

The relevance value R of a respective algorithm 14 is likewise calculated from the individual-case relevances R_e of this algorithm 14 by means of a statistical evaluation, e.g. a median value formation. Typically, higher individual-case relevances R_e also yield a higher relevance value R.

From the above, it becomes clear that a single report is typically not sufficient to identify and adapt one of the algorithms 14 as the most relevant algorithm 14 with satisfactory probability. In one configuration, the present potency aW of the most relevant algorithm 14 is thus adapted for the recommended potency eW only when the relevance value R of the most relevant algorithm 14 differs from the relevance values R of the other algorithms 14 by at least a minimum value dR. Accordingly, a period of time is waited until a distinction defined as sufficient above the minimum value dR is reached and one of the algorithms 14 is distinguished with sufficient certainty from the other algorithms 14. The minimum value dR is for example a minimum required difference between the highest relevance value R and the next highest relevance value R.

Moreover, the weights G in the database 10 are optionally updated on the basis of the adapted potency aW and the adapted potency aW is therefore taken into consideration from then on for ascertaining an individual-case relevance R_e and a recommended potency eW. The database 10 is therefore continually updated.

The adapted potency pW is used as the new, present potency aW from then on, and so the adapted potency pW is automatically used when the present situation arises again. The adapted potency pW is thus set directly by the hearing system 2 and is then the potency W that is used in future when an applicable situation arises. Should a report then still be made again, the method is continued as already described in order to obtain a further adaptation thereof or of another algorithm 14. As an alternative to the direct application of the adapted potency pW, the adapted potency is proposed to the user in a test mode initially and is used as the new present potency aW only after a confirmation by the user. The test mode is therefore used for test hearing, as it were, and the user is provided with the opportunity to test the adapted potency pW beforehand and then either to accept it or to reject it. This is made possible by way of appropriate input elements 38, e.g. on the hearing device or on the supplementary device 6.

In order to prevent possible constriction of the data in the database 10, optionally a different, experimental potency W is occasionally proposed in the test mode instead of an adapted potency pW, that is to say that the user is deliberately not offered the potency pW adapted on the basis of the method, but rather is intentionally offered a different and possibly less optimum potency W. If the experimental potency W is then nevertheless satisfactory for the user, he will accept the experimental potency W, and so said potency is used as the new present potency aW by the hearing system 2 from then on. The weights G in the database 10 are also updated on the basis of the experimental potency W, and said potency is therefore taken into consideration from then on for ascertaining an individual-case relevance R_e and a recommended potency eW. The experimental potency W is chosen to be higher or lower than the recommended potency eW, for example, or is a random value.

As shown in FIG. 1, the hearing system 2 contains at least one hearing device 4 and a database 10 as described above. The hearing device 4 is connected to the database 10 by way of a data connection 40, e.g. via the Internet, for the purpose of data interchange. The database 10 is a part of the server 8 here, which is accordingly a part of the hearing system 2. Furthermore, the hearing system 2 in the exemplary embodiment shown here also contains the supplementary device 6, which is used as a mediator between the hearing device 4 and the server 8 and to connect these for the purpose of data interchange. The hearing device 4 and the supplementary device 6 are connected by way of a Bluetooth connection, for example, for the purpose of data interchange, whereas the supplementary device 6 and the database 10 are connected via the Internet, which is not explicitly denoted, as shown in FIG. 1, for example.

In the exemplary embodiment shown, the calculation of the individual-case relevances R_e takes place on the server 8, but this is not imperative. By contrast, the calculation of the relevance values R here takes place on the supplementary device 6, which is likewise not imperative, however.

The following is a summary list of reference numerals and the corresponding structure used in the above description of the invention:

2 hearing system
4 hearing device
6 supplementary device
8 server
10 database
12 input signal
14 algorithm
16 microphone
18 signal processing
20 control unit
22 output signal
24 receiver
26 extraction unit
28 combination unit
30 main signal path
32 first secondary signal path
34 second secondary signal path
36 processed signal
38 input element
40 data connection
aW present potency, initial potency
dR minimum value
eW recommended potency
G weight
M signal feature
P weight profile
pW adapted potency
R_e individual-case relevance
S strength of the signal feature
V1 first method step
V2 second method step
V3 third method step
V4 fourth method step
W potency
X weight matrix
zW target potency

The invention claimed is:

1. A method for operating a hearing system having a hearing device and a database, which comprises the steps of:

configuring the hearing device to modify an input signal for a purpose of sound output to a user and, to that end, to apply multiple algorithms with a respective potency, as a result of which a respective algorithm of the algorithms is applied with a present potency in a present situation;

configuring the hearing system to recurrently receive a report from the user indicating that the user is dissatisfied with the sound output in the present situation;

configuring the database to contain a plurality of weights for each of the algorithms, in order to affect a rate of change of the respective potency, wherein, if the report is received, each of the algorithms is rated by using the weights to ascertain an individual-case relevance for each of the algorithms, in order to assess an effect of a change of the respective potency in the present situation; and combining multiple individual-case relevances to form a relevance value for each of the algorithms, relevance values are compared with one another, this is taken as a basis for selecting a most relevant algorithm, and then an adapted potency is used for the most relevant algorithm by adapting the present potency of the algorithm for a recommended potency determined on a basis of the weights.

2. The method according to claim 1, wherein each of the algorithms has at least one assigned signal feature and the present potency of the respective algorithm is set depending on a situation by setting the present potency on a basis of a strength of the at least one assigned signal feature in the input signal in the present situation.

3. The method according to claim 2, wherein the database is in a form such that the strength of the at least one assigned signal feature is taken into consideration for ascertaining the individual-case relevance and the recommended potency.

4. The method according to claim 1, wherein a respective weight of the weights indicates what proportion of users in a reference group prefers an associated change.

5. The method according to claim 4, wherein the reference group contains only the users who are similar to the user.

6. The method according to claim 1, wherein the recommended potency is calculated from the weights by means of a statistical evaluation.

7. The method according to claim 1, which further comprises calculating the individual-case relevance on a basis of a potency difference, which is a difference between the present potency and the recommended potency.

8. The method according to claim 1, which further comprises calculating the individual-case relevance on a basis of a change recommendation, which is a measure of a sum of the weights for changing to a different potency, on the one hand, compared with the weight for retaining the present potency, on the other.

9. The method according to claim 1, which further comprises calculating the individual-case relevance on a basis of a measure of scatter for the present potency.

10. The method according to claim 1, which further comprises calculating the relevance value of the respective algorithm from the individual-case relevances of the respective algorithm by means of a statistical evaluation.

11. The method according to claim 1, which further comprises adapting the present potency of the most relevant algorithm for the recommended potency only when the relevance value of the most relevant algorithm differs from the relevance values of other ones of the algorithms by at least a minimum value.

12. The method according to claim 1, which further comprises updating the weights in the database on a basis of the adapted potency and the adapted potency is therefore taken into consideration from then on for ascertaining the individual-case relevance and the recommended potency.

13. The method according to claim 1, wherein the adapted potency is proposed to the user in a test mode and is used as a new present potency only after a confirmation by the user.

14. The method according to claim 13, wherein a different, experimental potency is occasionally proposed in the test mode instead of the adapted potency.

15. The method according to claim 4, wherein the reference group contains only the users for whom a similar audiogram to that for the user was ascertained.

16. The method according to claim 1, wherein the recommended potency is calculated from the weights by means of a mean value formation or a median value formation.

17. The method according to claim 1, which further comprises calculating the relevance value of the respective algorithm from the individual-case relevances of the respective algorithm by means of a median value formation.

18. A hearing system or hearing device configured to carry out a method according to claim 1.

* * * * *